US008393476B2

(12) United States Patent
Vicherat

(10) Patent No.: US 8,393,476 B2
(45) Date of Patent: Mar. 12, 2013

(54) AUTOMATIC GELATIN CAPSULE SORTING MACHINE

(75) Inventor: Roland Vicherat, Ammerschwihr (FR)

(73) Assignee: Soldopha S.A.R.L., Ammerschwihr (FR)

( * ) Notice: Subject to any disclaimer, the term of this patent is extended or adjusted under 35 U.S.C. 154(b) by 198 days.

(21) Appl. No.: 13/060,806

(22) PCT Filed: Sep. 5, 2008

(86) PCT No.: PCT/FR2008/001235

§ 371 (c)(1),
(2), (4) Date: Feb. 25, 2011

(87) PCT Pub. No.: WO2010/026300

PCT Pub. Date: Mar. 11, 2010

(65) Prior Publication Data

US 2011/0147280 A1 Jun. 23, 2011

(51) Int. Cl.
*B07C 5/00* (2006.01)

(52) U.S. Cl. ..... 209/639; 209/522; 209/539; 209/680

(58) Field of Classification Search ..... 209/522, 209/539, 639, 644, 680; 141/114, 239
See application file for complete search history.

(56) References Cited

U.S. PATENT DOCUMENTS

| | | | | |
|---|---|---|---|---|
| 691,876 | A * | 1/1902 | Scott | 209/680 |
| 1,701,641 | A * | 2/1929 | Skriba | 209/634 |
| 2,646,912 | A * | 7/1953 | Reveno | 53/436 |
| 3,070,932 | A * | 1/1963 | Hofliger | 53/281 |
| 3,997,058 | A | 12/1976 | Greer et al. | |
| 5,661,249 | A * | 8/1997 | Rupp et al. | 73/865.8 |
| 5,772,045 | A * | 6/1998 | Zanarini | 209/643 |
| 6,189,676 | B1 | 2/2001 | Ansaloni | |
| 6,435,230 | B2 | 8/2002 | Wurst et al. | |
| 6,739,455 | B2 * | 5/2004 | Yamamoto et al. | 209/643 |
| 6,741,731 | B1 * | 5/2004 | Yamamoto et al. | 382/141 |
| 7,082,738 | B2 * | 8/2006 | Konishi et al. | 53/281 |
| 2012/0207272 | A1 * | 8/2012 | Runft et al. | 378/57 |

FOREIGN PATENT DOCUMENTS

| | | |
|---|---|---|
| DE | 100 27 008 A1 | 12/2001 |
| EP | 0 518 058 A1 | 12/1992 |
| WO | 2007/012966 A1 | 2/2007 |

* cited by examiner

*Primary Examiner* — Joseph C Rodriguez
(74) *Attorney, Agent, or Firm* — Davis&Bujold, PLLC

(57) ABSTRACT

A machine enabling automatic sorting of defective gelatin capsules based on the diameter and the weight of the capsule. The machine enables the automatic selection and rejection of the gelatin capsules having assembly and metering defects. The device consists of a rimmed selection disk rotating on an inclined plane of about 20 degrees relative to the horizontal direction. The disk has one or two rows of suitably sized apertures drilled about its circumference for holding the defective gelatin capsules until the defective gelatin capsules are automatically expelled by a blast nozzle. The properly assembled gelatin capsules pass freely through the sized apertures. While falling, the gelatin capsules individually pass a blast screen which expels the flawed gelatin capsules. Acceptable gelatin capsules are not deflected by the air blast and are discharged from the machine via the outlet chute.

6 Claims, 1 Drawing Sheet

AUTOMATIC GELATIN CAPSULE SORTING MACHINE

This application is a national stage completion of PCT/FR2008/001235 filed Sep. 5, 2008.

FIELD OF THE INVENTION

The present invention relates to a machine for the automated sorting of defective gelatin capsules according to their diameter and weight. The machine can be used on the empty gelatin capsules production machines after partial closing, as well as at the inlet and outlet of the machines filling these gelatin capsules. This machine allows automatic selection and rejection of gelatin capsules showing the following defects:

- Assembly defect characterized by a pinch or a tear between both of the parts, cap and body, that make up the gelatin capsule.
- These gelatin capsules will be called telescoped gelatin capsules. Dosing defect of the gelatin capsule, such as empty or lowly dosed gelatin capsules.
- Single parts, i. e. separated caps and bodies.

BACKGROUND OF THE INVENTION

Various sorting devices for gelatin capsules with an assembly defect are already known and used in production.

A first example of such a device is made of several sieves arranged for forming a cylinder with a horizontal axis. Each sieve has several openings calibrated at a diameter slightly larger, by some hundredths of a millimeter, than that of the gelatin capsules.

The gelatin capsules enter this cylinder through one of its sides. The cylinder rotates to stir the gelatin capsules continuously. The properly closed gelatin capsules pass through the openings of the sieves. On the other hand, those showing an assembly defect remain trapped inside of the sieve, since their deformation does not allow them to pass through the calibrated openings. This system has the following defects:

- The ejection of the defects requires a manual intervention of the operator and a complete stoppage of the production machine.
- The continuous stirring of the rejects can lead to the passage of a defect through the selection opening.
- During a longer operation time, product residues tend to reduce the passage diameter of the calibrated openings, requiring a manual intervention for the cleaning.

Another machine uses a blowing device to eject the empty (non dosed) or single parts (separated caps and bodies). The disadvantage of this system is that it does not process the gelatin capsules individually. The gelatin capsules are processed in clusters and, quite often, the defective parts cannot be expelled because they are drawn along by the other gelatin capsules.

Publication U.S. Pat. No. 3,997,058 describes another example of an automatic gelatin capsules sorting device. It includes a horizontal disk mounted in rotation above a fixed plate and having on its periphery calibrated openings arranged so as to receive only one gelatin capsule at a time. The fixed plate is spaced away from the disk by a distance slightly larger than the length of a gelatin capsule cap. This way, the single gelatin capsules, which are shorter than the conforming gelatin capsules, fall directly through the openings and are collected on the fixed plate and evacuated by vacuum means, while the properly assembled gelatin capsules are retained above the fixed plate in the various openings, before being evacuated by gravity during the rotation of the disk. The gelatin capsules having a diameter larger than that of a conforming gelatin capsule are retained on the upper surface of the disk and evacuated by vacuum means. Although this system facilitates processing of the gelatin capsules individually, it does not give satisfaction at the present time, since it is particularly complex and expensive, as it requires three sorting and evacuation levels.

SUMMARY OF THE INVENTION

The device according to the invention integrates the two functions of selection (telescoped gelatin capsules and empty, lowly dosed and single gelatin capsules) while remedying the various existing disadvantages mentioned previously.

The machine is made of a sieve having the form of a selection disk with or without a rim, its axis is inclined by about twenty degrees with respect to the vertical. In the case of a selection disk without rim, the frame of the machine serves as a rim in order to contain the gelatin capsules.

Calibrated openings adapted to the format of the gelatin capsules to be sorted are drilled at the periphery of this disk.

Each opening is made of the three following sections: a conical inlet to facilitate the tipping over and the introduction of the gelatin capsules, a calibrated section with a diameter larger, by some hundredths of a millimeter, than that of the shape of the gelatin capsule and a section with a larger diameter that facilitates the descent of the conforming gelatin capsules. The opening may contain several superimposed gelatin capsules.

The gelatin capsules to be sorted enter the machine continuously through an inlet chute and fall in the lower part of the selection disk, which is driven in rotation by the driving shaft. They enter the calibrated openings and are conveyed towards the upper section of the device.

In case of excessive supply (missing disk sorting capacity or selection disk stoppage), the excess of gelatin capsules overflow into a specific container (called "overflow").

The height of the rim and the inclination angle of the disk are defined to prevent the gelatin capsules from covering the entirety of its surface, grouping them in the lower section.

In the upward movement phase of the gelatin capsules, a flexible scraper device helps the introduction of the gelatin capsules into the openings of the selection disk.

A fixed plate (called "retaining plate") located underneath the sieve obstructs the outlet of the openings, forcing the gelatin capsules to remain superimposed vertically in them. A passage hole is drilled in the retaining plate in the alignment of the selection disk openings in its upper section. When the gelatin capsules arrive vertically above this opening, those showing no assembly defect pass freely through the calibrated openings. While falling, they pass individually in front of an "empty gelatin capsules expulsion blowing" curtain. The empty, lowly dosed and single (separated cap and body) gelatin capsules are blown into a specific reject container (called "dosing defects container"). The conforming gelatin capsules insignificantly deviate and fall into the outlet chute.

The gelatin capsules with an assembly defect remain trapped in the calibrated selection disk openings. After an additional rotation of a quarter turn, these gelatin capsules pass above the "automatic telescoped gelatin capsules ejection blowing" nozzle and are ejected upwards, via a chute, into a specific reject container. (called "assembly defects container").

This blowing also ensures automatic cleaning of the calibrated selection disk openings.

For low sorting rate applications, the selection disk includes only one row of calibrated openings. On the other hand, for high sorting rates, the openings are distributed in two staggered rows. The drilling angle of the openings is carried out in such a way that the outlets of the openings of both rows end on a same or almost same diameter of the disk.

This important characteristic allows for individual exposure of all gelatin capsules when they pass in front of the empty gelatin capsules expulsion blowing curtain.

In the case of a use on the empty gelatin capsules production machines after partial closing or at the inlet of the filling machines, the empty gelatin capsules expulsion blowing curtain and the retaining plate are not required.

BRIEF DESCRIPTION OF THE DRAWINGS

The attached drawings illustrate the invention.

DETAILED DESCRIPTION OF THE INVENTION

With reference to FIGS. 1, 2, 3 and 4, the sorting machine is made of a selection disk 1 placed on a drive shaft 2.

This set is inclined by about twenty degrees to force the gelatin capsules to remain in the lower section of the disk. The gelatin capsules slide in the inlet chute and fall in the lower section of the selection disk (on the left side on FIG. 2).

The drive shaft makes the selection disk rotate. The gelatin capsules enter into the calibrated openings that are drilled at the periphery of the disk. The inclination of the disk and the flexible scraper device 3 help the introduction of the gelatin capsules in the openings. The height of the rim is defined so as to prevent the gelatin capsules, yet to be sorted, from covering the entirety of the disk.

In case of excessive supply or selection disk stoppage, the excess of gelatin capsules flows over in a specific container (called "overflow container").

Each opening of selection disk 1 is made as follows: a conical inlet to facilitate the tipping over and the introduction of the gelatin capsules, a calibrated section with a diameter larger by some hundredths of a millimeter than that of the gelatin capsule. The opening ends having a section with a larger diameter facilitates the passage of the conforming gelatin capsules. The opening has a length that is sufficient to contain several superposed gelatin capsules.

Figure 1:
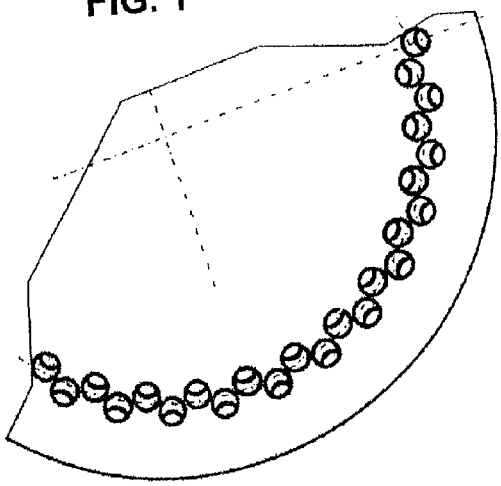
FIG. 1 represents the selection disk seen from the bottom.
Figure 3:
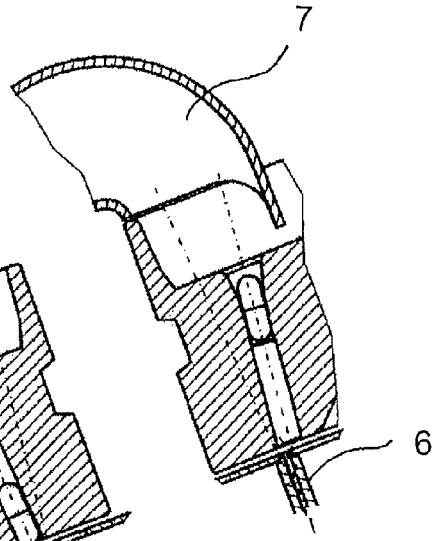
FIG. 3 represents the selection disk, vertically above the telescoped gelatin capsules ejection nozzle.
Figure 2:
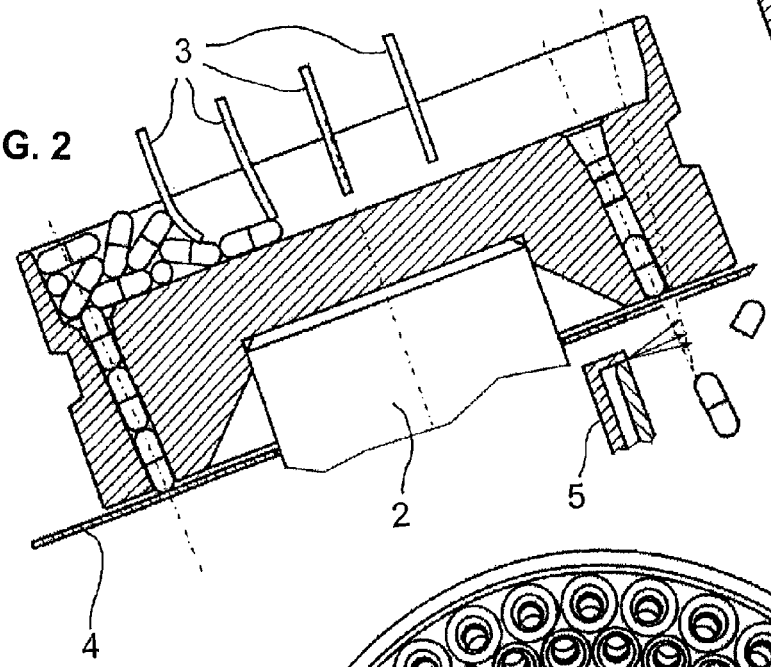
FIG. 2 represents the selection disk on its axis according to section line 2-2 of FIG. 4.
Figure 4:
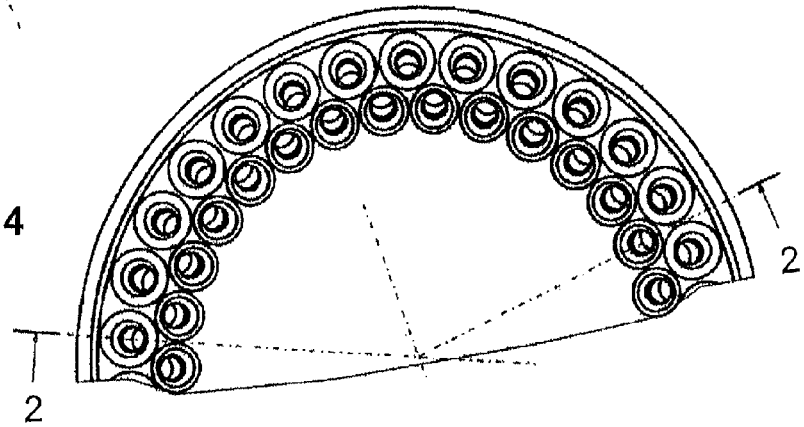
FIG. 4 represents the selection disk seen from the top.

At the level of the conical inlet section, the openings are distributed on two staggered rows (see FIG. 4). The drilling angle of the openings is carried out in such a way that the outlets of the openings of both rows end on a same or almost same diameter of the disk (FIG. 1).

This important characteristic allows for individual exposure of all gelatin capsules when they pass in front of the empty gelatin capsules expulsion blowing curtain.

For low sorting rates, the selection disk will comprise only one row of calibrated openings drilled perpendicularly to the surface of the disk.

The gelatin capsules accommodated in the openings are stopped by retaining plate 4 (left section of FIG. 2) and move upwards to the upper position thanks to the rotation of the selection disk. After half a revolution, a passage hole is drilled in the retaining plate to allow for the evacuation of the gelatin capsules (right section of FIG. 2). The gelatin capsules with a conforming diameter pass through the calibrated opening. While falling, they pass in front of the "empty gelatin capsules expulsion blowing" curtain 5. The empty, lowly dosed gelatin capsules and the single parts (separated gelatin capsule caps and bodies) are deflected by the blowing curtain into a specific reject container (called "dosing defects container"). The heavier conforming gelatin capsules are not deflected and fall in the conforming gelatin capsules outlet chute.

The gelatin capsules with an assembly defect remain trapped in the calibrated openings. After an additional selection disk rotation of a quarter turn (FIG. 3), the trapped gelatin capsules pass above the automatic telescoped gelatin capsules ejection blowing nozzle 6 and are ejected upwards, via a chute 7, in a specific reject container (called "assembly defects container").

The invention claimed is:

1. A device for automated sorting of gelatin capsules according to a diameter and a weight thereby facilitating elimination of deformed gelatin capsules, poorly assembled gelatin capsules, empty gelatin capsules, lowly dosed gelatin capsules and single gelatin capsules, the device comprising:

a selection disk (1) being inclined by about twenty degrees with respect to horizontal and rotationally driven relative and above a retaining plate (4), a periphery of the selection disk (1) being drilled to from calibrated openings therein, the retaining plate (4) comprising an opening, in an upper section of the device, located in front of an outlet of the gelatin capsules, and the device comprising a blowing curtain (5), underneath the retaining plate opening, for deflecting by blowing at least one of the deformed gelatin capsule, the poorly assembled gelatin capsule, the empty gelatin capsule, the lowly dosed gelatin capsule and the single gelatin capsule.

2. The device according to claim 1, wherein the openings of the selection disk have a length that is sufficient to contain at least one superimposed gelatin capsule.

3. The device according to claim 1, wherein the selection disk is drilled, about its periphery, with two rows of calibrated openings, each of the two rows of calibrated openings is able to contain at least one superimposed gelatin capsule, the openings in the selection disk are distributed in a staggered arrangement at a level of a conical inlet section, while a drilling angle of the openings in the selection disk are formed such that outlets of the two rows of calibrated openings, in the selection disk, terminate at either a same or a substantially the same diameter.

4. The device according to claim 1, wherein each of the calibrated openings of the selection disk comprise a conical inlet, a calibrated cylindrical section, with a diameter larger by at least a hundredth of a millimeter than a diameter of the gelatin capsule to be received therein, and a widened cylindrical section.

5. The device according to claim 1, wherein the device includes a blowing nozzle (6), located underneath the selection disk, along an outlet axis of the calibrated openings, for ejection of the at least one of the deformed gelatin capsule, the poorly assembled gelatin capsule, the empty gelatin capsule, the lowly dosed gelatin capsule and the single gelatin capsule into an ejection chute (7).

6. A device for automated sorting of a plurality of gelatin capsules according to diameter and weight to eliminate substandard gelatin capsules, the device comprising:

a selection disk (1) being inclined at an angle of essentially twenty degrees with respect to horizontal, the selection disk (1) being supported and rotationally driven by a drive shaft (2), a retaining plate (4) being supported adjacent a lower surface of the selection disk (1), the selection disk (1) comprising a plurality of calibrated through-bores located within and about a periphery of the selection disk (1), the retaining plate (4) comprising a passage in an upper section of the device, and the passage in the retaining plate (4) being radially aligned with the plurality of calibrated through-bores such that, as the selection disk (1) rotates relative to the retaining plate (4), any substandard gelatin capsule, located within the plurality of calibrated through-bores, pass therefrom through the passage in the retaining plate (4), and a blowing curtain (5) being located on a side of the retaining plate (4) opposite the selection disk (1) and adjacent the passage in the retaining plate (4) such that the blowing curtain (5) blows any substandard gelatin capsule into a rejection container as the substandard gelatin capsules exit the passage in the retaining plate (4).

* * * * *